US005356003A

United States Patent [19]

Gretz et al.

[11] Patent Number: 5,356,003

[45] Date of Patent: Oct. 18, 1994

[54] GOLF BAG WITH STAND

[75] Inventors: Jon J. Gretz, Springfield, Tenn.; James L. Shenoha, Lockport, Ill.

[73] Assignee: Wilson Sporting Goods Co., Chicago, Ill.

[21] Appl. No.: 919,070

[22] Filed: Jul. 23, 1992

[51] Int. Cl.[5] ..... A63B 55/10

[52] U.S. Cl. ..... 206/315.7; 248/96

[58] Field of Search ..... 206/315.6, 315.7, 315.8, 206/315.3; 248/96; 211/70.2

[56] References Cited

U.S. PATENT DOCUMENTS

| | | | |
|---|---|---|---|
| 1,170,891 | 2/1916 | Graf | 248/96 |
| 1,176,031 | 3/1916 | Cady | 206/315.7 X |
| 1,471,766 | 10/1923 | Wolfe | 206/315.7 X |
| 1,591,914 | 7/1926 | Farish | 206/315.7 X |
| 1,681,225 | 8/1928 | Earl | 206/315.7 X |
| 1,693,889 | 12/1928 | Dick | 206/315.7 X |
| 1,790,092 | 1/1931 | Duguid | 248/96 |
| 1,880,351 | 10/1932 | McDonald | 248/96 |
| 1,890,362 | 12/1932 | Bellow | 206/315.7 |
| 1,895,366 | 1/1933 | Beard . | |
| 1,924,182 | 8/1933 | Fritz | 206/315.7 X |
| 1,954,413 | 4/1934 | Hunter | 206/315.7 |
| 1,975,702 | 10/1934 | Sterling . | |
| 2,119,695 | 6/1938 | Woodcock | 248/96 |
| 2,186,491 | 1/1940 | Meyer | 206/315.7 |
| 2,199,055 | 4/1940 | Staugaitis | 206/315.7 X |
| 2,282,842 | 5/1942 | Abell | 248/96 |
| 2,324,439 | 7/1943 | Thommen | 248/96 |
| 2,327,736 | 8/1943 | Pearson | 248/96 |
| 2,408,777 | 10/1946 | Holbrook | 206/315.7 |
| 2,422,315 | 6/1947 | Robinson | 206/315.7 |
| 2,571,088 | 10/1951 | Walton | 248/96 |
| 2,572,408 | 10/1951 | Vanden Hoek | 248/96 X |
| 2,661,174 | 12/1953 | Sands | 206/315.7 X |
| 2,663,528 | 12/1953 | Hadley | 248/96 |
| 2,749,069 | 6/1956 | Sandstrom | 248/96 |
| 2,768,668 | 10/1956 | Santosuosso | 206/315.7 |
| 3,195,844 | 7/1965 | Roepke | 248/96 |
| 3,787,017 | 1/1974 | Sauer | 248/96 |
| 4,054,256 | 10/1977 | Buck, Jr. et al. | 248/96 |
| 4,087,068 | 5/1978 | Gardner | 248/96 |
| 4,226,389 | 10/1980 | Neth | 248/96 |
| 4,506,854 | 3/1985 | Kim | 248/96 |
| 4,620,682 | 11/1986 | Yim | 248/96 |
| 4,676,464 | 6/1987 | Reimers | 248/96 |
| 4,739,958 | 4/1988 | Sato | 248/96 |
| 4,778,136 | 10/1988 | Reimers | 248/96 |
| 4,782,948 | 11/1988 | Weise | 206/315.7 |
| 4,798,357 | 1/1989 | Cho | 248/96 |
| 4,834,235 | 5/1989 | Solheim | 206/315.7 |
| 4,921,192 | 5/1990 | Jones | 248/96 |
| 4,949,844 | 8/1990 | Yang | 206/315.7 |
| 4,953,768 | 9/1990 | Muse | 206/315.7 X |
| 5,036,974 | 8/1991 | Ross | 206/315.7 |
| 5,042,654 | 8/1991 | Jones | 206/315.7 X |
| 5,048,777 | 9/1991 | Quellais | 248/96 |
| 5,082,218 | 1/1992 | Hoffman | 206/315.7 X |
| 5,096,148 | 3/1992 | Quellais et al. | 206/315.7 X |
| 5,147,089 | 9/1992 | Anderson | 206/325.7 X |
| 5,154,377 | 10/1992 | Suk | 248/96 |

FOREIGN PATENT DOCUMENTS

| | | | |
|---|---|---|---|
| 79201218 | 1/1990 | Taiwan . | |
| 23350 | of 1911 | United Kingdom | 248/96 |
| 157632 | 1/1921 | United Kingdom | 206/315.6 |
| 211693 | 2/1924 | United Kingdom | 206/315.6 |
| 331668 | 7/1930 | United Kingdom | 206/315.6 |
| 1094106 | 12/1967 | United Kingdom | 248/96 |
| 1376394 | 12/1974 | United Kingdom | 248/96 |

*Primary Examiner*—Sue A. Weaver

[57] ABSTRACT

A golf bag is equipped with a stand for supporting the bag in a generally upright position. The stand includes a pair of support legs which are pivotally attached to the top of the bag. The golf bag is carried by a bag strap, and a leg strap is attached to one of the support legs and is attached to the bag strap for pivoting the support legs to a closed position when the bag strap is lifted and for allowing the support legs to pivot to an open position when the bag strap is relaxed.

20 Claims, 6 Drawing Sheets

GOLF BAG WITH STAND

BACKGROUND

This invention relates to golf bags, and, more particularly, to a golf bag with a stand for supporting the golf bag in a generally upright position.

Golf bags generally include a bag strap for carrying the bag between shots. After the golfer selects a club for the next shot, the bag is placed on the ground.

Golf bags equipped with a stand for supporting the bag in a generally upright position have become increasingly popular in recent years. For example, U.S. Pat. Nos. 4,676,464 and 4,778,136 describe golf bag stands which include a pair of pivoting support legs which pivot between open and closed positions. The lower ends of the bag strap are threaded through the bag and are attached to the legs so that the legs are pulled closed by the bag strap when the bag strap is lifted. Elastic straps attached to the legs pivot the legs to the open position when the bag strap is relaxed.

The support legs described in the patents pivot independently, and the bag strap and the elastic straps are attached to each of the legs to cause the legs to pivot together. Further, the support legs are attached to the bag a substantial distance below the top of the bag, thereby reducing the stability of the stand.

SUMMARY OF THE INVENTION

The invention provides a golf bag stand which includes a pair of support legs which pivot together. A spring which is attached to one or both of the legs moves both legs to the open position. The support legs are closed by a separate leg strap which is attached to one of the support legs and is slidably attached to the bag strap or to the top of the bag. When the bag strap is lifted, the leg strap pulls the support legs closed. When the bag strap is relaxed, the leg strap slides along the bag strap and allows the support legs to open. The support legs are pivotally attached to the top of the bag to provide excellent stability.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
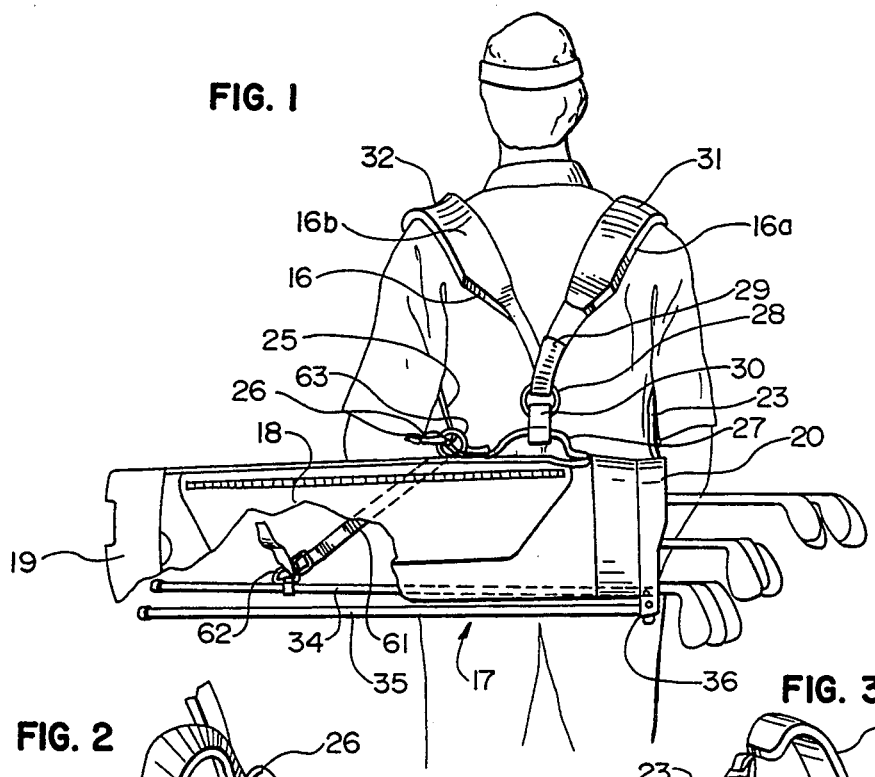
FIG. 1 illustrates a golf bag equipped with a bag stand being carried by a golfer.
Figure 2:
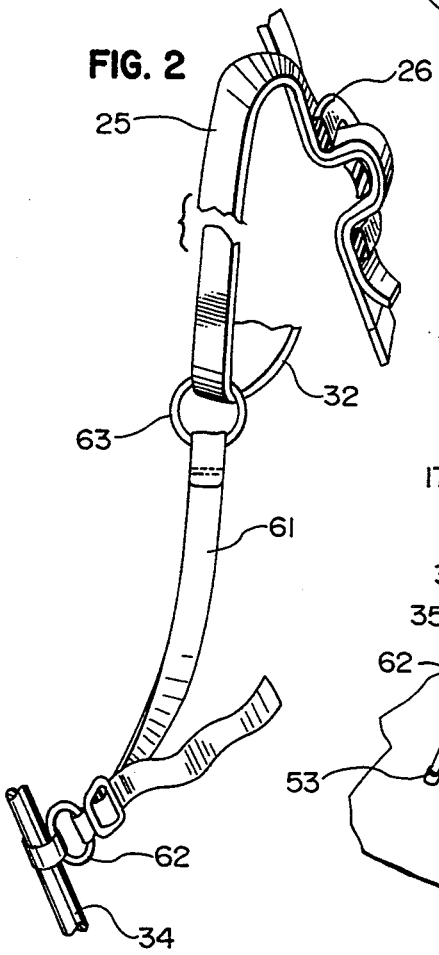
FIG. 2 is a fragmentary view of the leg strap and a portion of the bag strap.
Figure 3:
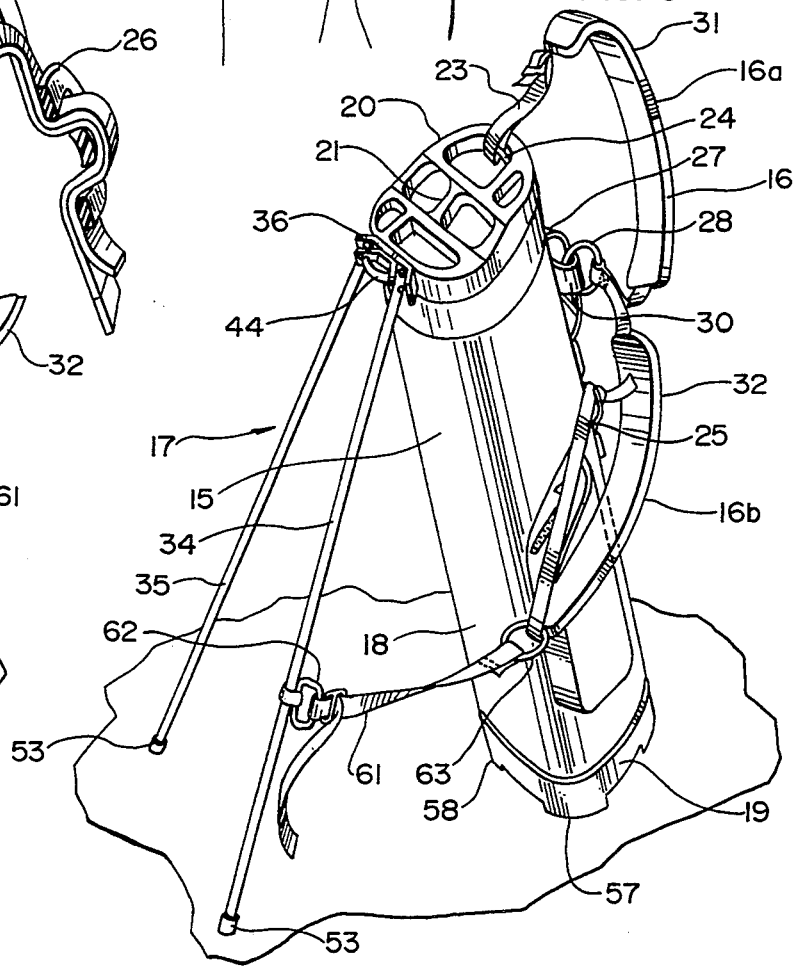
FIG. 3 is a perspective view of the golf bag supported by the stand.
Figure 5:
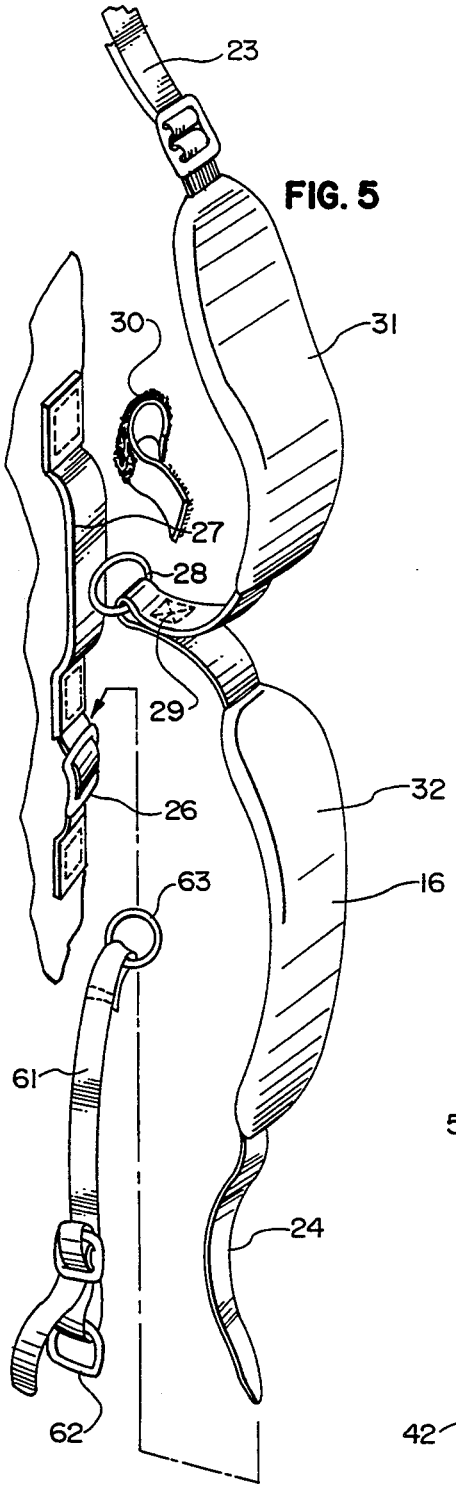
FIG. 5 is an exploded perspective view of the leg strap and the bag strap.

Referring to FIGS. 1 and 3, a golf bag 15 includes a bag strap 16 and a bag stand assembly 17. The bag includes an elongated tubular body 18 which may be made from nylon, cloth, vinyl, or the like, a cup shaped plastic base 19 which is attached to the bottom of the body, and a generally cylindrical plastic collar 20 which is attached to the open upper end of the body. The collar includes a plurality of divider walls 21 which provide compartments for storing golf clubs.

The particular bag strap illustrated is a "double strap" structure which is made in accordance with U.S. Pat. Nos. 5,038,784, 5,042,703, and 5,042,704. The bag strap includes a first end 23 which is attached to a loop 24 on the collar 20 and a second end 25 which is threaded through a buckle 26 which is attached to the bag. A handle 27 is attached to the bag approximately midway between the buckle 26 and the loop 24. The midportion of the strap extends through a ring 28, and the strap is stitched together at 29 to fix the position of the ring. The ring is releasably secured to the handle 27 by a Velcro strap 30. The top half of the strap between the ring 28 and the loop 24 forms a first strap portion **16*a* which is looped over the right shoulder of a golfer. The bottom half of the strap between the buckle 26 and the ring 28 forms a second strap portion 16*b* which is looped over the left shoulder. The strap portions 16*a* and 16*b* include shoulder pads 31 and 32**, respectively. It will be understood, however, that the bag may be equipped with a conventional bag strap which is attached to the upper end of the bag and to a point on the bag intermediate the upper and lower ends.

Figure 6:
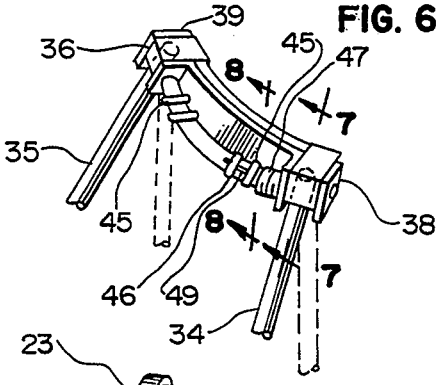
FIG. 6 is an enlarged fragmentary perspective view of the pivot portion of the stand.
Figure 4:
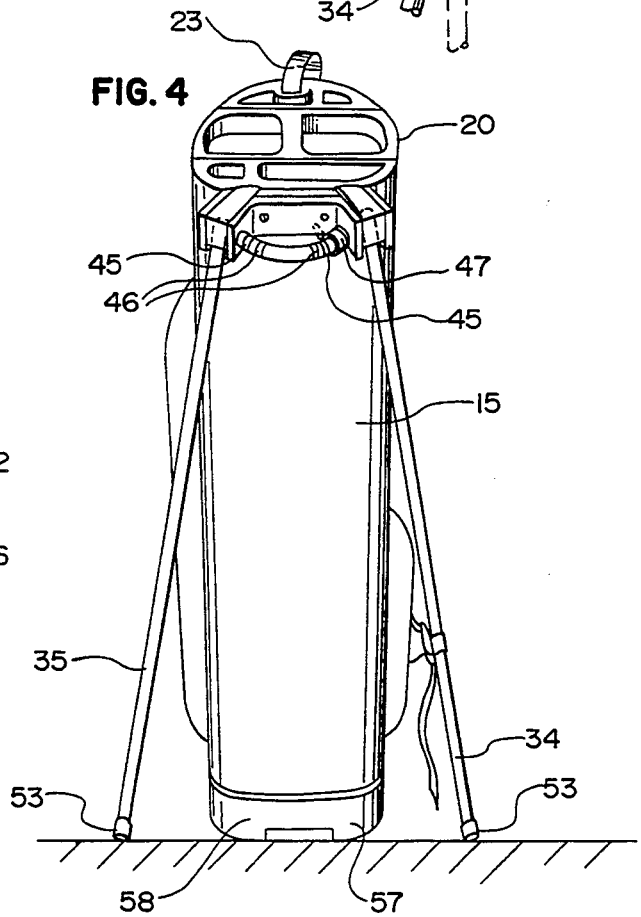
FIG. 4 is a front view of the bag and bag stand.
Figure 14:
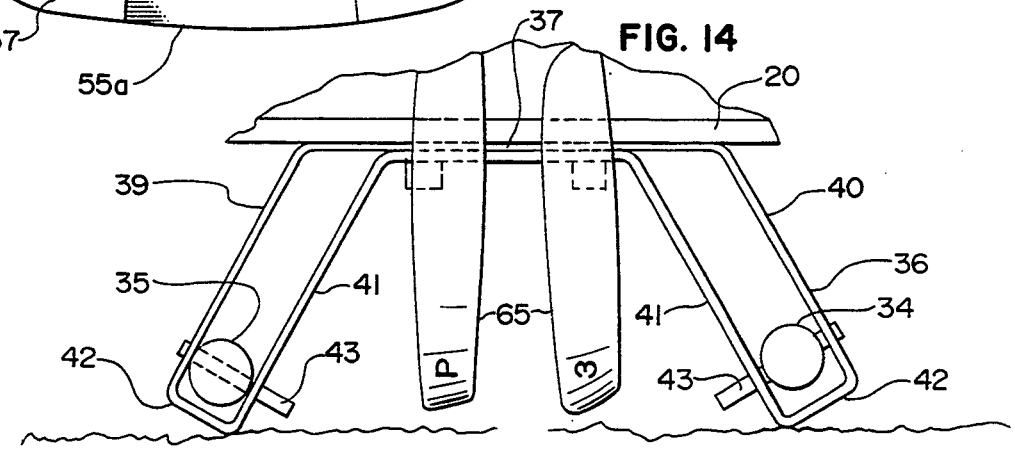
FIG. 14 illustrates the top of the bag being supported on the ground by the mounting bracket of the stand.

The bag stand assembly 17 includes a pair of support legs 34 and 35 which are pivotally attached to a mounting bracket 36 which is secured to the collar 20. Referring to FIGS. 4, 6, and 14, the mounting bracket includes a generally flat central portion 37 which is riveted to the collar and a pair of end portions 38 and 39 which diverge away from the central portion and form an included angle of about 60°. Each end portion includes a pair of flat, parallel spaced-apart plates 40 and 41 and an end plate 42. A pivot pin 43 (FIGS. 7 and 14) is rotatably mounted in openings in the parallel plates of each end portion. The pivot pins are perpendicular to the end portions of the bracket, and the axes of the pivot pin form an included angle which is complementary to the included angle of the end portions. The included angle formed by the pivot pins in FIG. 14 is about 120°.

Each pivot pin passes through one of the support legs 34 and 35 and is secured thereto so that the support leg rotates with the pivot pin. The pivot pins are connected by a flexible plastic tube 44 so that they rotate together. Each end of the tube is ensleeved over one of the pivot pins and is secured to the pin by hose clamps 45 and 46. The tube 44 can flex relative to its axis so that it can be connected to the angularly related pivot pins, but the tube resists torsional twisting so that the tube transmits rotation of one of the pivot pins to the other pivot pin. A torsion spring 47 includes a central coil 48 which encircles one end of the tube, a first end 49 which extends along the tube and is anchored by the clamps 45 and 46, and a second end 50 which engages the central portion 37 of the mounting bracket 36.

Figure 7:
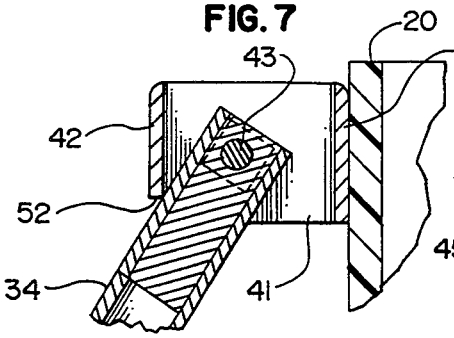
FIG. 7 is a sectional view taken along the line 7—7 of FIG. 6.
Figure 8:
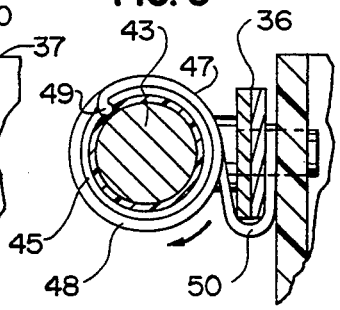
FIG. 8 is a sectional view taken along the line 8—8 of FIG. 6.

The torsion spring 47 resiliently biases the support leg 34 to pivot away from the bottom of the bag to an open position illustrated in FIG. 3. As the support leg 34 and the associated pivot pin rotate, the flexible tube 44 twists and transmits rotational movement to the other pivot pin and the support leg 35. Referring to FIG. 7, the end plates 42 of the mounting bracket are notched at 52 to permit the support legs to pivot, but the bottom edges of the end plates provide stops to prevent the legs from pivoting beyond their open position illustrated in FIG. 3. A rubber or plastic cap 53 is fitted over the bottom of each support leg to reduce the tendency of the leg to penetrate the ground.

Because the end portions of the mounting bracket 36 and the pivot pins 43 are angled, the bottom ends of the support legs spread apart as they pivot away from the closed position illustrated in FIG. 1 to the open position in FIG. 3. In one specific embodiment of the invention, the bottom ends of the support legs were spaced about 24 inches apart, and the bottom of each leg was spaced about 24 inches from the bottom of the bag. The legs and the bottom of the bag thereby form an equilateral triangle and provide a stable, tripod support.

Figure 9:
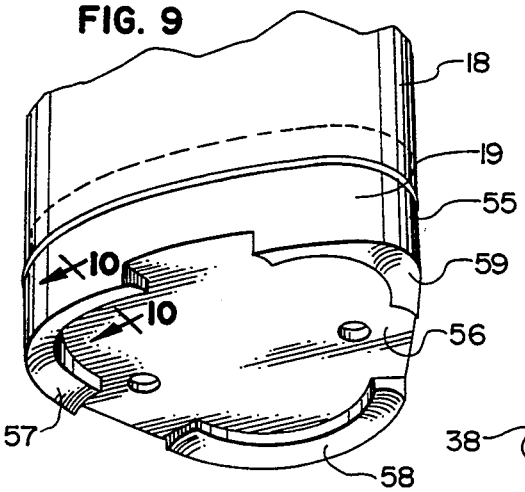
FIG. 9 is a fragmentary perspective view of the bottom of the golf bag.
Figure 10:
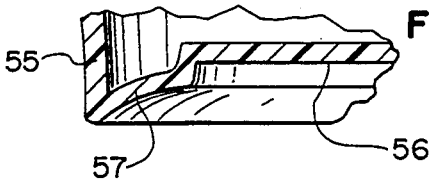
FIG. 10 is a fragmentary sectional view taken along the line 10—10 of FIG. 9.
Figure 11:
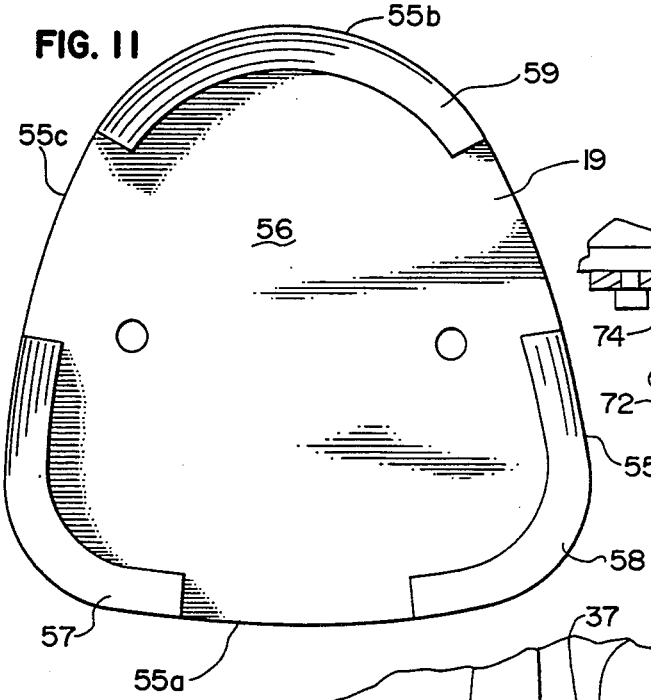
FIG. 11 is a bottom plan view of the base of the golf bag.

Referring to FIGS. 9–11, the molded plastic base 19 includes a tubular side wall 55 and a flat bottom wall 56 which extends perpendicularly to the centerline or axis of the tubular body 18. The side wall 55 includes a substantially flat portion **55*a* which is generally aligned with the mounting bracket 36, a curved portion 55*b* which is aligned with the bag strap 16 and bag handle 27, and a pair of generally curved portions 55*c* and 55*d*. A generally C-shaped support foot 57 extends downwardly from the bottom wall 56 and the side wall portions 55*a* and 55*c*. A C-shaped support foot 58 extends downwardly from the bottom wall and the side wall portions 55*a* and 55*d*. The C-shaped support feet 57 and 58 curve in a plane which is parallel to the bottom wall 56. A third support foot 59 extends downwardly from the bottom wall and the side wall portion 55*b*. All three support feet support the bag when the bag is upright. When the bag is supported in an inclined position by the bag stand, the two spaced apart support feet 57 and 58 provide a stable two-point support (see FIG. 4**). The two feet provide much greater stability than would be provided by the rounded edge of a conventional base.

The support legs 34 and 35 are automatically pulled from the open position of FIG. 3 to the closed position of FIG. 1 when the bag is lifted by the bag strap 16. A leg strap 61 is attached to the support leg 34 by a ring 62 which is mounted on the support leg. The other end of the leg strap is secured to a ring 63. The bottom end portion 25 of the bag strap extends through the ring 63.

When the bag is placed upright on the ground and the tension on the bag strap 16 is relieved, the torsion spring 47 forces the support legs to pivot away from the bag. The leg strap 61 is pulled by the support leg 34, and the ring 63 slides along the end portion 25 of the bag strap toward the shoulder pad 32 and pulls the bag strap toward the support leg 34. The length of the leg strap and the length of the end portion 25 of the bag strap between the buckle 26 and the shoulder pad 32 is sufficient to allow the support legs to pivot fully to their open position as shown in FIG. 3.

While the bag is supported by the bag stand, the golfer may select the desired club for the next shot. After he returns the club to the bag, he lifts the bag by the bag strap 16. As the bottom end portion 25 of the bag strap is raised, the ring 63 on the leg strap 61 slides along the bag strap toward the buckle 26 and is pulled toward the buckle. The leg strap directly pulls the support leg 34 toward the closed position, and a torsional force is transmitted to the other support leg by the flexible tube 44. The length of the leg strap is substantially the same as the distance between its point of attachment to the support leg 34 at ring 62 in the closed position of the leg and the buckle 26 so that the support legs will be retained alongside the tubular body of the bag when the end portion 25 of the bag strap extends upwardly from the body portion as illustrated in FIG. 1.

The support legs can be releasably locked in their closed position by slipping the ring 63 over the buckle 26 as illustrated in FIG. 1. The buckle 26 will hold the ring 63 and the leg strap against the force of the torsion spring 47 even when the lifting force on the bag strap is released. It is advantageous to lock the support legs closed when placing the golf bag in the trunk of a car or when a golfer or caddie wishes to use the golf bag without the bag stand feature.

Other means for locking the stand in a closed position can be used. For example, a Velcro patch on the leg strap can be releasably secured to a Velcro patch on the bag or on the bag strap.

Referring to FIG. 14, when the bag stand is not used, the open upper end of the golf bag may be supported by the end portions 38 and 39 of the mounting bracket 36 when the bag rests on the ground. The length of the end portions is advantageously sufficient to raise the open end of the bag above the ground so that the clubheads 65 do not contact the ground.

Figure 12:
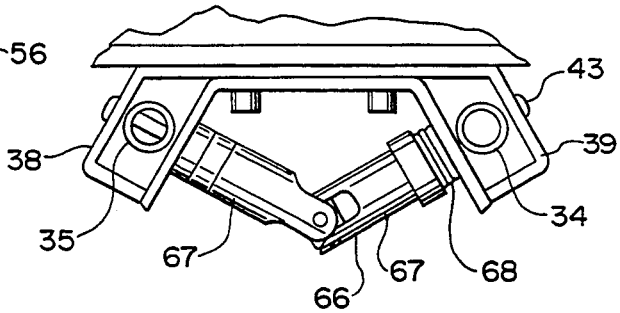
FIG. 12 is a top plan view of an alternate connector for the legs of the stand.

FIG. 12 illustrates an alternate connection means for the angled pivot pins 43. A conventional single joint universal joint 66 includes a pair of tubular bodies 67. The pivot pins are inserted into the bodies 67 and secured. A torsion spring 68 is mounted on one or both of the pivot pins, and rotation of one of the pivot pins is transmitted to the other pivot pin by the universal joint.

Figure 13:
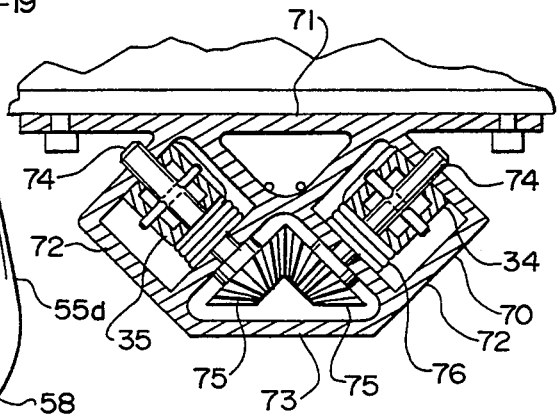
FIG. 13 is a sectional view of another alternate connector.

Another connection means is illustrated in FIG. 13. An extruded aluminum mounting bracket 70 includes an attaching plate 71, a pair of support leg housings 72, and a gear housing 73. Pivot pins 74 are rotatably mounted in the support leg housings 72, and the support legs 34 and 35 are mounted on the pivot pins. Bevel gears 75 are mounted on the ends of the pivot pins for transmitting rotation of one pivot pin to the other. A torsion spring 76 is mounted on one or both pivot pins.

The center of gravity of a golf bag which contains golf clubs is about in the middle of the bag. The support legs 34 and 35 extend from the top of the bag at a point which is substantially above the center of gravity. The support legs thereby provide a much more stable support than a bag stand which is attached to an intermediate portion of the bag, as illustrated, for example, in U.S. Pat. Nos. 4,676,464 and 4,778,136. A bag equipped with the inventive bag stand will remain stable on a slope which is inclined as much as 30° in a plane which bisects the support legs and the bag even without the base 19 which includes the two spaced-apart feet 57 and 58. The bag will remain stable when positioned sideways on a slope which is inclined as much as 16° in a plane which is perpendicular to the first plane.

Figure 15:
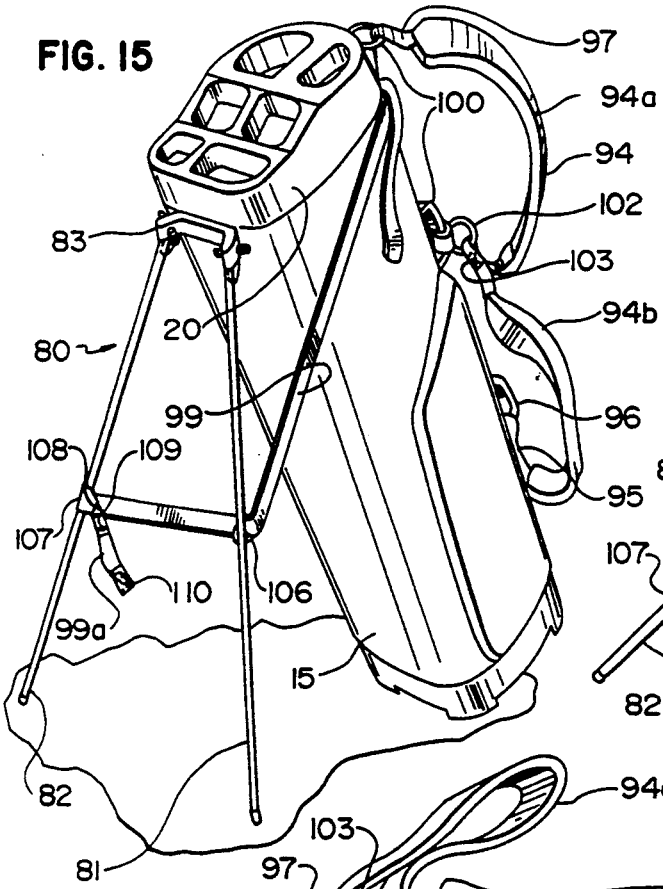
FIG. 15 is a view similar to FIG. 3 showing a modified bag stand, leg strap, and back strap.
Figure 20:
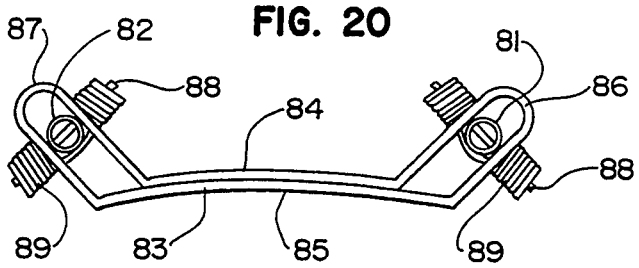
FIG. 20 is a top plan view of the bag stand of FIG. 19.

FIG. 15 illustrates another embodiment of a bag stand 80 for the golf bag 15. The bag stand includes a pair of support legs 81 and 82 which are pivotally attached to a mounting bracket 83 which is secured to the bag collar 20. Referring to FIG. 20, the bracket includes front and rear plates 84 and 85 and U-shaped end portions 86 and 87. Pivot pins 88 are mounted in the end portions and pivotally support the legs 81 and 82. A spring 89 is mounted on each of the pivot pins and resiliently biases the associated support leg to the open position illustrated in FIG. 15.

Figure 22:
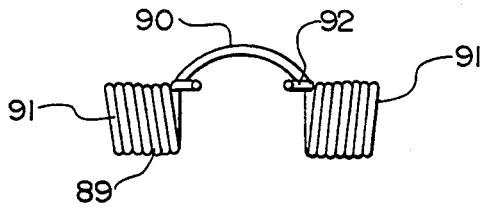
FIG. 22 is a top plan view of the spring of FIG. 21.
Figure 21:
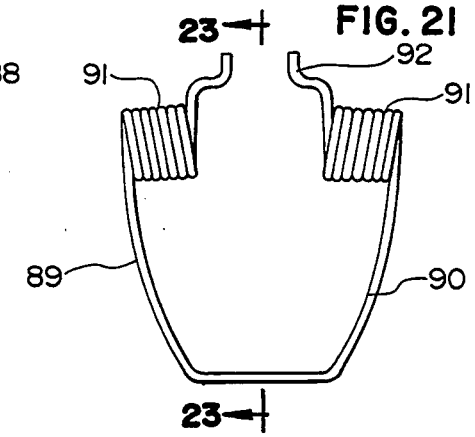
FIG. 21 is a front elevational view of one of the springs of FIG. 19.
Figure 23:
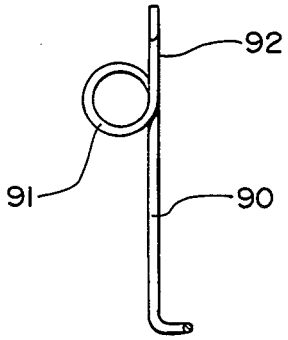
FIG. 23 is a sectional view taken along the line 23—23 of FIG. 21.

Referring to FIGS. 21–23, each spring 89 includes a U-shaped central portion 90 which engages one of the support legs, a pair of coil portions 91 which are ensleeved over the pivot pin 88, and a pair of S-shaped end portions 92 which extend over the upper edges of the end portions of the bracket.

Figure 16:
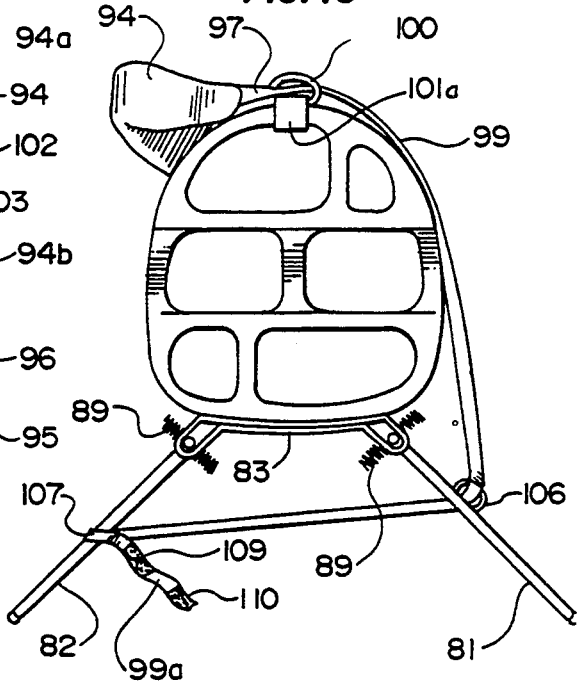
FIG. 16 is a top plan view of the bag of FIG. 15.

A bag strap 94 is similar to the bag strap 16 which was previously described, except that the upper end of the bag strap 94 is not secured to the bag. The bag strap includes a lower end 95 which is secured to a loop 96 on the bag and an upper end 97 which is attached by a buckle 98 to a leg strap 99. The upper end 97 of the bag strap and the leg strap 99 are threaded through a ring 100 which is secured to the collar of the bag by a strap 101*a* (FIG. 16). A handle 101 is attached to the bag approximately midway between the loop 96 and the ring 100. The midportion of the strap extends through a ring 102, and the strap is stitched together at 103 to fix the position of the ring. The ring is releasably secured to the handle 101 by a Velcro strap 104. The top half of the strap between the rings 102 and 100 forms a first strap portion 94A which is looped over the right shoulder of a golfer. The bottom half of the strap between the ring 102 and the loop 96 forms a second strap portion 94B which is looped over the left shoulder.

The leg strap 99 extends from its attachment to the bag strap through a ring 106 which is attached to the support leg 81 and around the support leg 82. The leg strap is looped around the support leg 82 to form a loop 107, and the two portions of the strap which form the loop are stitched together at 108. An end portion 99A of the leg strap extends freely from the stitching 108, and complementary Velcro fastening pads 109 and 110 are secured to the end portion 99A.

Figure 17:
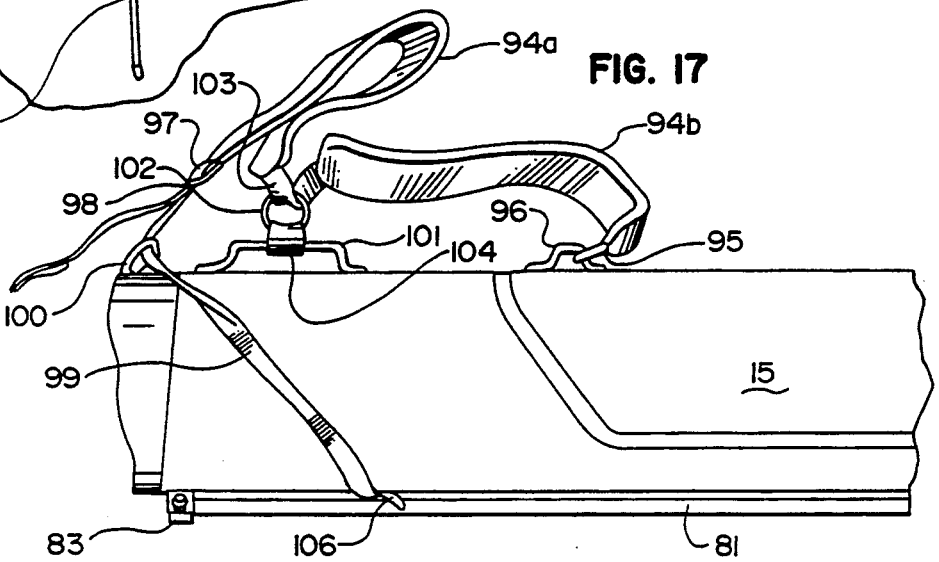
FIG. 17 is a fragmentary side elevational view of the bag of FIG. 15 showing the legs in the closed position.
Figure 18:
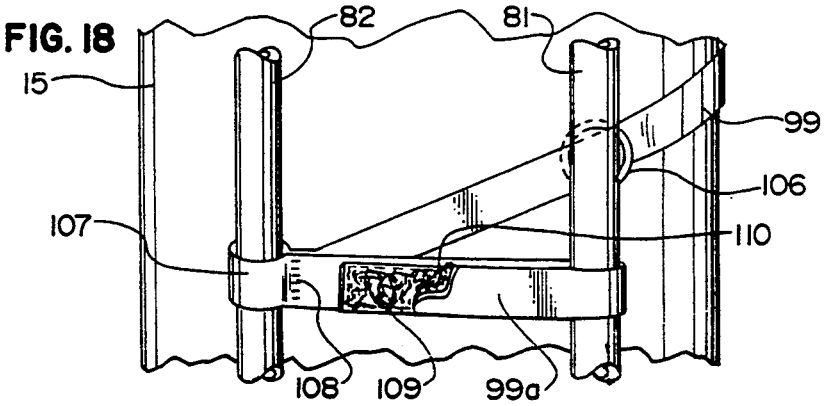
FIG. 18 is a fragmentary front elevational view of the bag showing the legs in the closed position.
Figure 19:
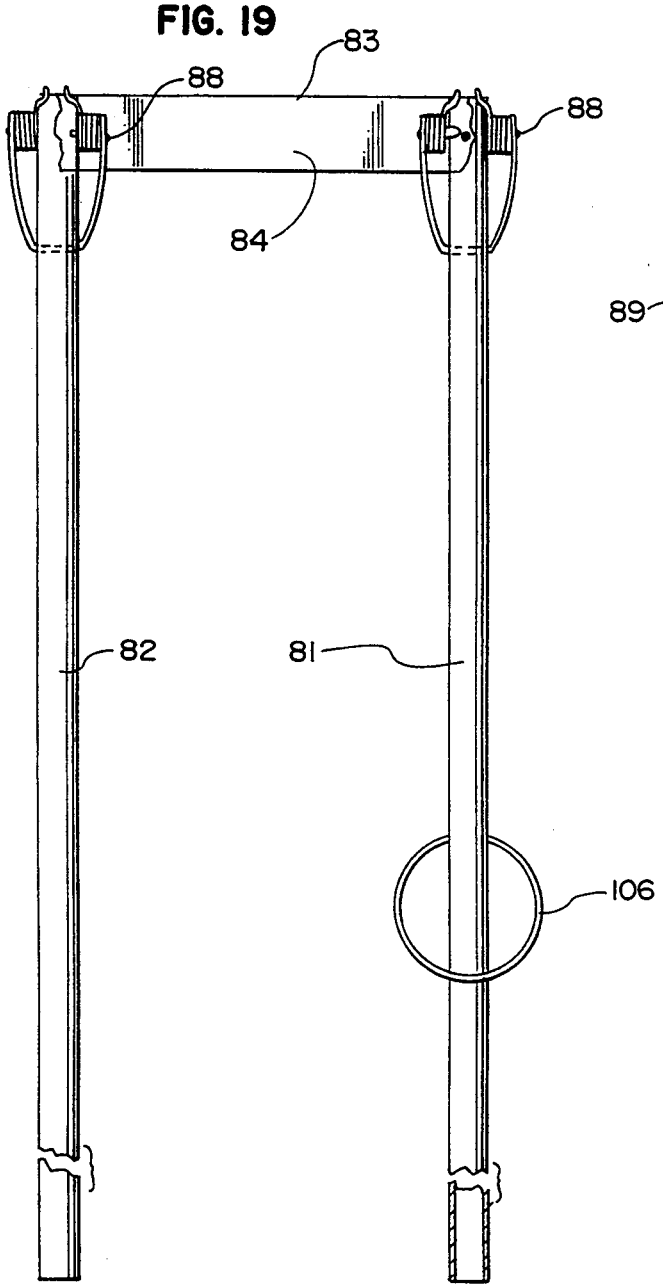
FIG. 19 is a front elevational view of the bag stand of FIG. 15.

The support legs 81 and 82 are automatically pulled from the open position of FIG. 15 to the closed position of FIG. 17 when the bag is lifted by the upper half 94A of the bag strap 94. Lifting the upper portion 94A of the bag strap pulls the leg strap 99 through the ring 100 at the top of the bag, thereby pulling the support legs 81 and 82 toward the golf bag. As the support legs pivot about the pivot pins 88, the bottom ends of the support legs move together until the support legs are substantially parallel as illustrated in FIGS. 17 and 19. The support legs can be releasably locked in their closed position by looping the end portion 99A of the leg strap around the support leg 81 and securing the Velcro pads 109 and 110 as illustrated in FIG. 17. The attachment between the Velcro pads will retain the support legs in their closed position against the bias of the springs 89 even when the lifting force on the bag strap is released.

If the support legs are not locked in their closed position by the Velcro pads 109 and 110, the support legs will automatically pivot to the open position when the bag is placed upright on the ground and the tension on the bag strap 94 is relieved. The springs 89 force the support legs 81 and 82 to pivot away from the bag and will pull the leg strap 99 through the ring 100 at the top of the bag.

When the bag is carried by the bag strap, the top of the bag is supported by the first bag strap portion 94*a* and the upper end portion of the leg strap 99 which extends through the ring 100. The bag is thereby supported by the ring 100 even though the bag strap is not secured to the ring.

Figure 24:
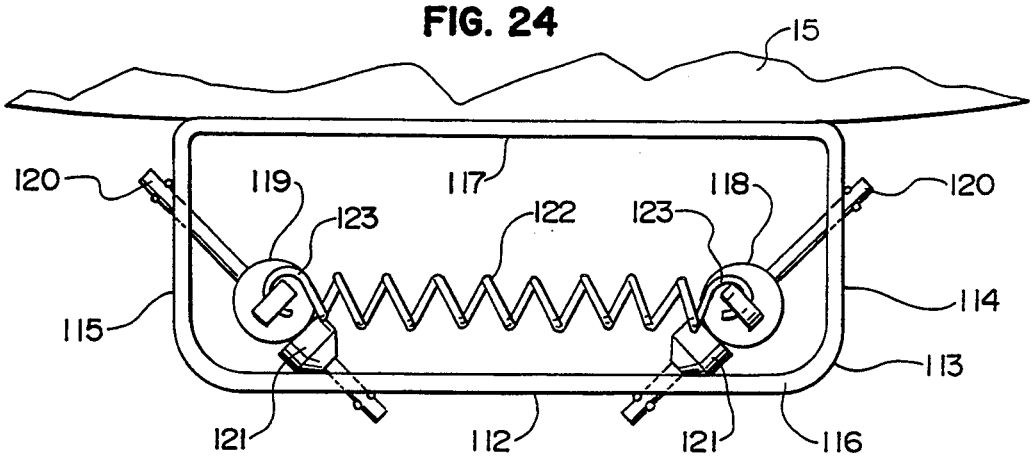
FIG. 24 is a top plan view similar to FIG. 20 of another embodiment of a bag stand showing the legs in the closed position.
Figure 25:
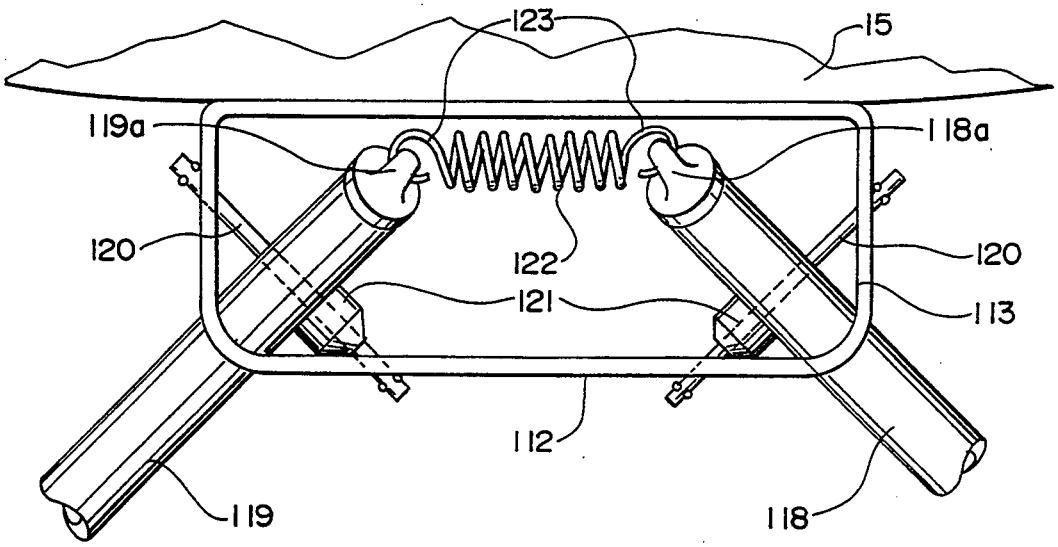
FIG. 25 is a fragmentary view of the bag stand of FIG. 24 showing the legs in the open position.
Figure 26:
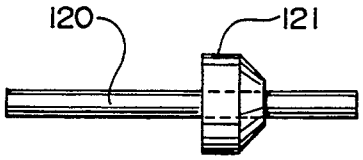
FIG. 26 is an elevational view of one of the pivot pins of FIGS. 24 and 25.

FIGS. 24 and 25 illustrate another embodiment of a mounting bracket 112 for a bag stand. The mounting bracket includes a generally rectangular frame 113 which can be formed of metal or plastic and which is attached to the golf bag 15. The metal frame includes a pair of side walls 114 and 115, a front wall 116, and a rear wall 117 which is attached to the bag. A pair of support legs 118 and 119 are pivotally supported by pivot pins 120. Each pivot pin extends at about a 45° angle to the front wall 116 and one of the side walls 114 and 115 of the frame and is pivotally mounted in openings in the walls. A plastic bushing 121 is mounted on the pivot pin between the support leg and the front wall 116 to maintain the spacing between the support leg and the front wall. A coil spring 122 extends between the upper ends of the support legs and is secured to reduced diameter upper end portions 118A and 119A by rings 123.

The support legs 118 and 119 are shown in their open position in FIG. 25. The upper ends of the legs are closest together when the legs are in the open position, and the bottom ends of the legs are farthest apart. The length of the spring 122 when it is not tensioned is less than the distance between the upper ends of the support legs in FIG. 25 so that the spring is tensioned even when the legs are in their open position.

When the legs are pivoted to their closed position illustrated in FIG. 24 by lifting the bag strap and pulling the leg strap, the upper ends of the legs pivot away from each other and further tension the spring 122. When the tension on the bag strap and the leg strap is relieved by resting the lower end of the bag on the ground, the spring 122 pulls the upper ends of the support legs together and causes the support legs to pivot about the pivot pins 120 to the open position of FIG. 25.

While in the foregoing specification a detailed description of specific embodiments of the invention was set forth for the purpose of illustration, it will be understood that many of the details herein given may be varied considerably by those skilled in the art without departing from the spirit and scope of the invention.

We claim:

1. A golf bag having an elongated generally tubular body with a bottom and an open top, a bag strap attached to the golf bag for carrying the golf bag, the bag strap having a first end supported by the bag adjacent the top thereof and a second end attached to the bag intermediate the top and the bottom thereof, a pair of support legs, means for pivotally attaching each of the support legs to the bag for movement between a closed position in which the legs extend generally along side the bag and an open position in which the legs extend away from the bag, a leg strap attached to one of the legs, and a ring attached to the leg strap, the bag strap extending slidably through the ring for pulling the legs to the closed position when the bag strap is lifted, and a buckle attached to the bag intermediate the top and bottom thereof, the second end of the bag strap being attached to the buckle, said ring being releasably engageable with said buckle for holding the legs in the closed position when the bag strap is not lifted.

2. The golf bag of claim 1 in which the length of the leg strap is substantially the same as the distance between the buckle and the attachment of the leg strap to said one leg when the legs are in the closed position.

3. A golf bag having an elongated generally tubular body with a bottom and an open top, a bag strap attached to the golf bag for carrying the golf bag, the bag strap having a first end supported by the bag adjacent the top thereof and a second end attached to the bag intermediate the top and bottom thereof, a mounting bracket attached to the bag adjacent the top of the bag, a pair of pivot pins pivotally mounted on the mounting bracket for pivoting movement about a pair of axes which are not parallel and which form an included angle of less than 180°, a support leg mounted on each of the pivot pins, the support legs being pivotable between a closed position in which the legs extend generally alongside the bag and an open position in which the legs extend away from the bag for supporting the bag by the two legs and the bottom of the bag, and means for connecting the support legs so that the support legs pivot together, the connecting means including a flexible tube which extends over each of the pivot pins and which is affixed thereto, the support legs being secured to the pivot pins for movement with the pivot pins.

4. The golf bag of claim 3 including spring means for resiliently biasing at least one of the support legs toward the open position.

5. The golf bag of claim 4 in which the spring means is operatively connected to one of the support legs and to the mounting bracket.

6. The golf bag of claim 3 in which the golf bag includes a collar attached to the tubular body around the open top and the mounting bracket is attached to the collar.

7. The golf bag of claim 3 in which the flexible tube is affixed to the pivot pins by clamps.

8. A golf bag having an elongated generally tubular body with a bottom and an open top, a bag strap attached to the golf bag for carrying the golf bag, the bag strap having a first end supported by the bag adjacent the top thereof and a second end attached to the bag intermediate the top and bottom thereof, a mounting bracket attached to the bag adjacent the top of the bag, a pair of pivot pins pivotally mounted on the mounting bracket for pivoting movement about a pair of axes which are not parallel and which form an included angle of less than 180°, a support leg mounted on each of the pivot pins, the support legs being pivotable between a closed position in which the legs extend generally alongside the bag and an open position in which the legs extend away from the bag for supporting the bag by the two legs and the bottom of the bag, and means for connecting the support legs so that the support legs pivot together, the connecting means including a universal joint which connects the two pivot pins, the support legs being secured to the pivot pins for movement with the pivot pins.

9. A golf bag having an elongated generally tubular body with a bottom and an open top, a bag strap attached to the golf bag for carrying the golf bag, the bag strap having a first end supported by the bag adjacent the top thereof and a second end attached to the bag intermediate the top and bottom thereof, a mounting bracket attached to the bag adjacent the top of the bag, a pair of pivot pins pivotally mounted on the mounting bracket for pivoting movement about a pair of axes which are not parallel and which form an included angle of less than 180°, a support leg mounted on each of the pivot pins, the support legs being pivotable between a closed position in which the legs extend generally alongside the bag and an open position in which the legs extend away from the bag for supporting the bag by the two legs and the bottom of the bag, and means for connecting the support legs so that the support legs pivot together, the connecting means comprising a gear mounted on each of the pivot pins for pivoting movement therewith, the gears on the pivot pins meshing so that rotation of one gear causes rotation of the other gear, the support legs being secured to the pivot pins for movement with the pivot pins.

10. A golf bag having an elongated generally tubular body with a bottom and an open top, a bag strap attached to the golf bag for carrying the golf bag, the bag strap having a first end supported by the bag adjacent the top thereof and a second end attached to the bag intermediate the top and bottom thereof, a mounting bracket attached to the bag adjacent the top of the bag, a pair of pivot pins pivotally mounted on the mounting bracket for pivoting movement about a pair of axes which are not parallel and which form an included angle of less than 180°, a support leg mounted on each of the pivot pins, the support legs being pivotable between a closed position in which the legs extend generally alongside the bag and an open position in which the legs extend away from the bag for supporting the bag by the two legs and the bottom of the bag, and means for connecting the support legs so that the support legs pivot together, the connecting means comprising a coil spring which is secured to the upper ends of the support legs.

11. A golf bag having an elongated generally tubular body with a bottom and an open top, a bag strap attached to the golf bag for carrying the golf bag, the bag strap having a first end supported by the bag adjacent the top thereof and a second end attached to the bag intermediate the top and bottom thereof, a mounting bracket attached to the bag adjacent the top of the bag, a pair of pivot pins pivotally mounted on the mounting bracket for pivoting movement about a pair of axes which are not parallel and which form an included angle of less than 180°, a support leg mounted on each of the pivot pins, the support legs being pivotable between a closed position in which the legs extend generally alongside the bag and an open position in which the legs extend away from the bag for supporting the bag by the two legs and the bottom of the bag, and means for connecting the support legs so that the support legs pivot together, and a base attached to the bottom of the tubular body, the base including a side wall, a bottom wall, and a pair of spaced-apart support feet which extend downwardly from the bottom wall for supporting the tubular body when the support legs are in the open position.

12. A golf bag having an elongated generally tubular body with a bottom and an open top, a bag strap attached to the golf bag for carrying the golf bag, the bag strap having a first end supported by the bag adjacent the top thereof and a second end attached to the bag intermediate the top and bottom thereof, a mounting bracket attached to the bag adjacent the top of the bag, a pair of pivot pins pivotally mounted on the mounting bracket for pivoting movement about a pair of axes which are not parallel and which form an included angle of less than 180°, a support leg mounted on each of the pivot pins, the support legs being pivotable between a closed position in which the legs extend generally alongside the bag and an open position in which the legs extend away from the bag for supporting the bag by the two legs and the bottom of the bag, and means for connecting the support legs so that the support legs pivot together, the mounting bracket including a central attaching portion which is attached to the bag and a pair of end portions which extend away from the attaching portion and which form an included angle of about 60°, the pivot pins being pivotally mounted on the end portions.

13. The golf bag of claim 12 in which the spacing between the bottom ends of the support legs in the open position is substantially the same as the spacing between each of the bottom ends of the support legs and the bottom of the bag.

14. The golf bag of claim 12 in which each of the end portions of the mounting bracket includes a pair of spaced-apart parallel plates, each of the support legs being positioned between the parallel plates of one of the end portions.

15. The golf bag of claim 14 in which each of the end portions of the mounting bracket includes an end plate which extends between the parallel plates and which is engageable by the support leg when the leg is in the open position.

16. The golf bag of claim 12 in which the end portions of the mounting bracket extend away from the golf bag a sufficient distance to support the top of the bag when the bag rests on the ground so that golf clubs within the bag do not contact the ground.

17. A golf bag having an elongated generally tubular body with a bottom and an open top, a bag strap attached to the golf bag for carrying the golf bag, the bag strap having a first end supported by the bag adjacent the top thereof and a second end attached to the bag intermediate the top and bottom thereof, a mounting bracket attached to the bag adjacent the top of the bag, a pair of pivot pins pivotally mounted on the mounting bracket for pivoting movement about a pair of axes which are not parallel and which form an included angle of less than 180°, a support leg mounted on each of the pivot pins, the support legs being pivotable between a closed position in which the legs extend generally alongside the bag and an open position in which the legs extend away from the bag for supporting the bag by the two legs and the bottom of the bag, means for connecting the support legs so that the support legs pivot together, and strap means attached to one of the legs and to the bag strap for pulling the legs to the closed position when the bag strap is lifted.

18. The golf bag of claim 17 in which the connecting means comprises a ring mounted on the other leg to which the strap means is not attached and said strap means extending from said one leg to which the strap means is attached and through the ring to the bag strap.

19. A golf bag having an elongated generally tubular body with a bottom and an open top, a bag strap attached to the golf bag for carrying the golf bag, the bag strap having a first end supported by the bag adjacent the top thereof and a second end attached to the bag intermediate the top and bottom thereof, a mounting bracket attached to the bag adjacent the top of the bag, a pair of pivot pins pivotally mounted on the mounting bracket for pivoting movement about a pair of axes which are not parallel and which form an included angle of less than 180°, a support leg mounted on each of the pivot pins, the support legs being pivotable between a closed position in which the legs extend generally alongside the bag and an open position in which the legs extend away from the bag for supporting the bag by the two legs and the bottom of the bag, means for connecting the support legs so that the support legs pivot together, a bag ring attached to the bag adjacent the top of the bag, a leg strap attached to the one of the legs, and a leg ring mounted on the other leg, the leg strap extending from said one leg and through the leg ring and through the bag ring to the first end of the bag strap.

20. The golf bag of claim 19 in which the leg strap includes an end portion which extends from said one leg and fastening means on the end portion, whereby the legs can be maintained in the closed position by looping the end portion of the leg strap around the other leg and securing the looped end portion by the fastening means.

* * * * *